United States Patent [19]

Kawahara

[11] 4,382,713

[45] May 10, 1983

[54] PAVEMENT WATER CONSERVATION METHOD

[76] Inventor: Sakae Kawahara, 1455-8 Hirotani-Cho, Funchu-City, Hiroshima-Pref, 726, Japan

[21] Appl. No.: 173,824

[22] Filed: Jul. 30, 1980

[51] Int. Cl.[3] ..... E01F 5/00

[52] U.S. Cl. ..... 404/4; 404/27; 404/72

[58] Field of Search ..... 404/1, 2, 4, 5, 71, 404/72, 47, 27; 405/42; 239/271, 542; 210/165, 164

[56] References Cited

U.S. PATENT DOCUMENTS

| | | | |
|---|---|---|---|
| 149,367 | 4/1874 | Yundt | 405/42 |
| 216,673 | 6/1879 | Hamilton | 405/42 |
| 245,721 | 8/1881 | Henning | 404/2 |
| 838,450 | 12/1906 | Redemeyer | 404/4 |
| 2,993,650 | 7/1961 | Badberg | 239/271 |
| 3,138,078 | 2/1961 | Nojima | 404/71 |

FOREIGN PATENT DOCUMENTS

| | | | |
|---|---|---|---|
| 492165 | 4/1953 | Canada | 404/72 |
| 1293157 | 3/1961 | France | 404/2 |
| 22683 | of 1909 | United Kingdom | 404/4 |
| 573506 | 11/1945 | United Kingdom | 404/4 |
| 576813 | 4/1946 | United Kingdom | 404/71 |

*Primary Examiner*—Nile C. Byers, Jr.
*Assistant Examiner*—Roberto L. Calderon
*Attorney, Agent, or Firm*—William W. Haefliger

[57] ABSTRACT

Apparatus is provided to reduce wastage of water draining from pavements.

6 Claims, 4 Drawing Figures

PAVEMENT WATER CONSERVATION METHOD

BACKGROUND OF THE INVENTION

This invention relates generally to water drainage from pavements or the like, and more particularly to apparatus to reduce wastage of water draining from such pavement.

In the conventional paving method, the whole surface of a road is completely paved with asphalt or concrete, and rain and water on the surface may not permeate the ground, but flows in the side drainage of a road as for example along gutters to drain tunnels. Therefore, in case of heavy rain, the drainage overflows, causing the side edge of a road to be weakened and it may frequently become a cause of collapse. Also, water is wasted.

SUMMARY OF THE INVENTION

It is a major object of the invention to reduce or eliminate the above problems and water wastage, especially in dry areas.

Basically, the invention is embodied in a receiver or receivers (piles) adapted for use in combination with pavement. Such receivers are sized to be located in holes associated with the pavement and so as to project underground into the earth; they are hollow and have water entrances at there upper ends; and they have water distributors for downwardly and sidewardly draining water into the underground earth, as for example to irrigate plant or tree roots that are otherwise covered by pavement and sidewalks that block access of water to such roots.

Other advantages are embodied in the simple and effective low cost construction of the receivers, enabling ready driving or burying in holes in the pavement, and as will be described.

These and other objects and advantages of the invention, as well as the details of an illustrative embodiment, will be more fully understood from the following description and drawings, in which:

DRAWING DESCRIPTION

DETAILED DESCRIPTION

Figure 4:
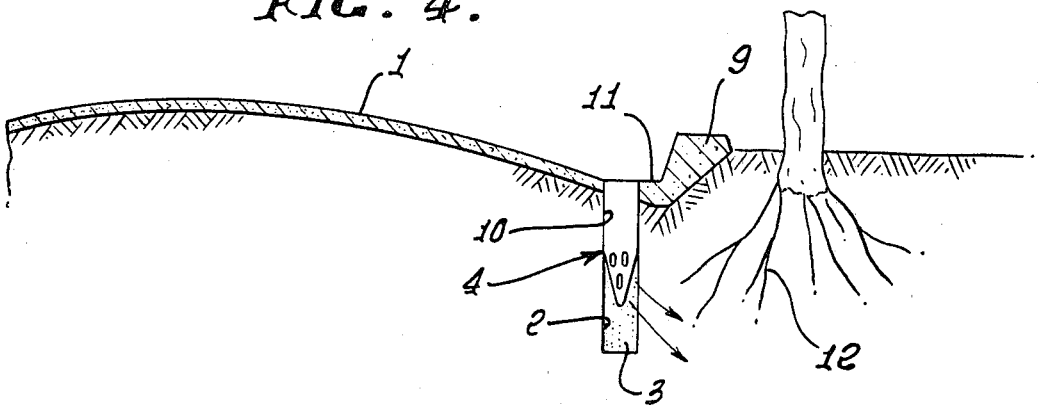
FIG. 4 is an elevation, in section showing an application of the invention.

The surface of a road which is paved with concrete or asphalt is indicated at 1. The road may be crowned as shown in FIG. 4. A hole 2 is made, one per interval of 500 mm to 5,000 mm, on said road surface so that the hole may reach the ground under the pavement. The diameter of the hole may be 5 mm to 300 mm. Besides, said hole is filled up with pebbles or foam concrete. The above embodiment has explained the case in which a hole 2 is made and pebbles or concrete pieces (for example) are filled into the hole as at 3. A pipe or receiver formed as shown in FIG. 2 is then driven into the hole, as for example is shown in FIG. 4.

Pile 4 contains a shell made of metal or synthetic resin, whose outer diameter is 5 mm to 300 mm and its length is sufficient that the pile may reach the ground under the pavement as shown at 10 in FIG. 4. The pile or receiver casing is conically and cylindrically formed at **4*a* and 4*b* and is provided with a plurality of water-passing openings 5, at least at its water distributing tip end. Also, the pile is filled up with pebbles or foam concrete 6. Therefore, in this embodiment, one may bury or drive the pile 4 in the hole 2 made in the pavement of a road, as for example in the manner seen in FIG. 4**.

Figure 1:
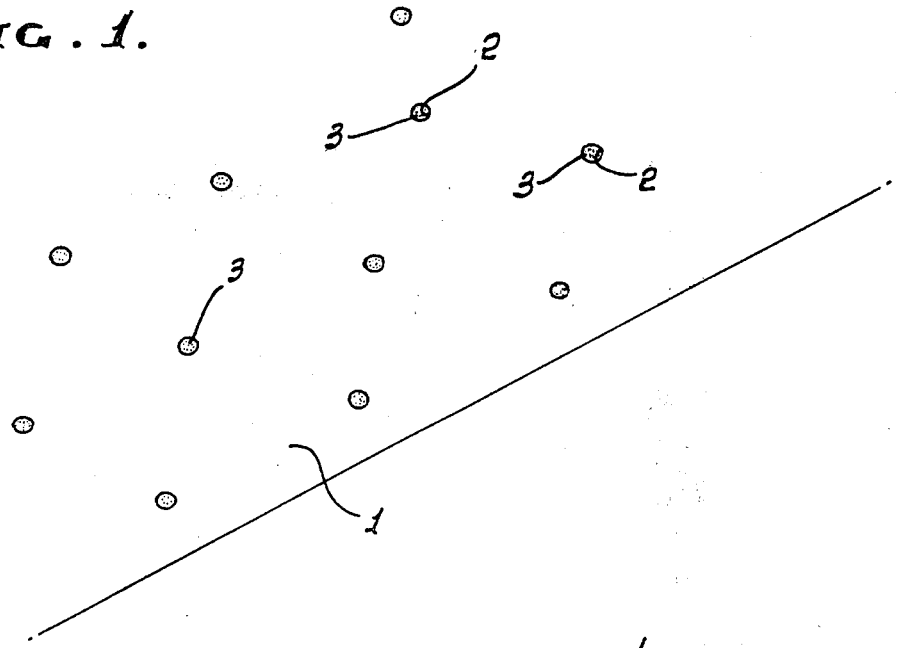
FIG. 1 is a perspective view of an application of the invention.
Figure 2:
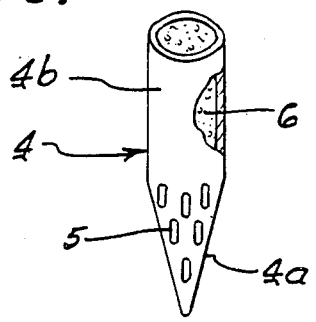
FIG. 2 is a perspective view of a driving pile (water receiver) incorporating the invention.
Figure 3:
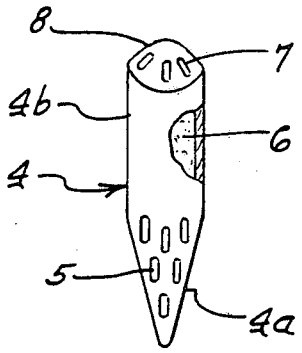
FIG. 3 is a view like FIG. 2 showing a modification.

In the above FIG. 2 embodiment, the upper end of the pile is formed to be open to receive water. However, that upper surface may be provided with water-passing holes 7 in a closure 8 that is upwardly concavely curved, as shown in FIG. 3.

In operation, and during a rainfall or washing of the road surface, water percolates into the ground through holes 2 made in the pavement and via the piles. These can be especially effective when located in gutters 11 adjacent curbs 9, as shown in FIG. 4, to irrigate roots 12. The present invention can therefore eliminate wastage of water. Also, conventionally paved asphalt roads may often be cracked or softened by water, which evaporates when said asphalt is heated by the sun. The road employing the present invention avoids such problems, due to spreading of water underground, and to roots.

The number and diameter of holes made in pavement according to the present invention may reasonably change due to the conditions (slope or plain) of a road and to the weather conditions of the district where the road runs. However, according to many experiments made by the present inventor, the invention is most effective when the receivers have diameters between 5 mm and 300 mm and which are spaced at interval of 500 mm to 5,000 mm. The receiver may than be spaced along road gutters.

I claim:

1. In combination with pavement and a cylindrical hole through the pavement and extending into the ground therebelow, the combination comprising (a) a water receiver located in said hole in the pavement and ground, the receiver being hollow, (b) said receiver having a top exposed to pass water into the receiver hollow interior, and (c) said receiver having a water distributor in the hole below the pavement for sidewardly and downwardly distributing water, into the underground earth, (d) said distributor having a downwardly tapering conical lower portion which contains through perforations spaced from the wall of the hole to pass water into the hole, (e) said hole containing pebbles about said conical portion and perforations, and therebelow, the hole and pebbles extending downwardly to substantial depth below the lowermost extent of said distributor, (f) the receiver having an associated upwardly domed closure across its upper end, the closure being perforated, the receiver filled with rocks or rock like pieces, below said closure, (g) and the receiver having a cylindrical shell body having a diameter between 5 mm and 300 mm, between said closure and said conical lower portion.

2. The combination of claim 1 wherein said pavement defines a road which is crowned to drain water toward said receiver.

3. The combination of claim 1 including multiple of said holes and receivers therein to receive water draining from said pavement, said holes laterally spaced apart, said receivers having the same configuration as defined in claim 1.

4. The combination of claim 1 including vegetation growing in said earth near said hole and having root structure to be irrigated by water distributed from the receiver.

5. The combination of claim 3 wherein said receiver has an open upper end and is filled with rocks or rock like pieces.

6. The combination of claim 3 wherein the receiver has a closure across its upper end, the closure being perforated, the receiver filled with rocks or rock like pieces.

* * * * *